US006915740B2

(12) United States Patent
Pozuelo et al.

(10) Patent No.: US 6,915,740 B2
(45) Date of Patent: Jul. 12, 2005

(54) PRINTING APPARATUS AND A METHOD FOR LOADING MEDIA IN SAID APPARATUS

(75) Inventors: Francisco Javier Pozuelo, Barcelona (ES); Francisco Guerrero, Barcelona (ES); Juan Carles Rubio, Barcelona (ES); Roberto Guillen, Barcelona (ES); Joan Matias Guerra, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/438,217

(22) Filed: May 15, 2003

(65) Prior Publication Data

US 2004/0009025 A1 Jan. 15, 2004

(30) Foreign Application Priority Data

May 17, 2002 (GB) ..... 0211249

(51) Int. Cl.[7] ..... B41F 13/54

(52) U.S. Cl. ..... 101/228; 101/227; 101/288; 156/264; 156/277

(58) Field of Search ..... 101/227, 228, 101/288, 92, 178, 219; 156/264, 265, 277; 400/606

(56) References Cited

U.S. PATENT DOCUMENTS 5,807,461 A * 9/1998 Hagstrom ..... 156/361
6,261,012 B1 * 7/2001 Haas et al. ..... 400/208
6,409,872 B1 * 6/2002 Campion et al. ..... 156/264
6,585,366 B2 7/2003 Nagata et al.
2004/0003733 A1 * 1/2004 Guillen et al. ..... 101/228

FOREIGN PATENT DOCUMENTS

GB 1 439 858 6/1976

* cited by examiner

*Primary Examiner*—Andrew H. Hirshfeld
*Assistant Examiner*—Marissa Ferguson
(74) *Attorney, Agent, or Firm*—Foley & Lardner LLP

(57) ABSTRACT

The printing apparatus comprises a printer and a laminator; media that advances and is printed in the printer is fed to the laminator device. The apparatus comprises means for loading in the laminator device the leading edge of the media leaving the printer, said loading means comprising a carrier, on which no printing is performed, attached to the leading edge of the media and to take-up means downstream of the laminator device, such that said carrier travels through the laminator device. Said carrier may comprise a length of lamination film, or a sheet or strips and means for their attachment to the media.

The loading method comprises providing a carrier travelling through the laminator and attached to the leading edge of the media and to take-up means, and causing the carrier to advance leading the media through the laminator.

21 Claims, 7 Drawing Sheets

PRINTING APPARATUS AND A METHOD FOR LOADING MEDIA IN SAID APPARATUS

The present invention relates to a printing apparatus comprising a printer and a laminator, and to a method for loading media in said apparatus.

BACKGROUND OF THE INVENTION

The applicant has developed an apparatus which is able to laminate plots that are outputted by a printing device, in a continuous operation. A media, such as a continuous web of paper, is printed in a printing device and then may be fed to an integrated laminator device so that at least some of the printed plots are laminated.

In such an apparatus it is advisable to avoid the need of lengthy user intervention, for example at the beginning of the printing operation on a fresh web or reel of media, especially when the apparatus is intended for professional use.

Moreover, it is of course advisable to minimize defects in the printed and laminated plots, for example defects in lamination due to skew of the media in the laminator device, and to avoid media waste.

These requirements are especially significant in the case of large format apparatus, i.e. apparatus which are able to work with media widths of 600 mm (24 inches) or more: on one hand, the length of the printed plots and the speed of the printer implies that a significant time lapses between the moment in which printing is started and the moment in which the first plot may be fed to the laminator, and the user would need to wait during this time to feed the media manually to the laminator; on the other hand, media behaviour makes it difficult to obtain good results when handling the media manually, for example at the input of the laminator.

DESCRIPTION OF THE INVENTION

According to a first aspect, the present invention provides a printing apparatus comprising a printer and a laminator device, in which media that advances and is printed in the printer is subsequently fed in an integrated operation to the laminator device and advanced therethrough to laminate at least part of said media, the apparatus further comprising means for loading in the laminator device the leading edge of the media leaving the printer, wherein said loading means comprise a carrier, on which no printing is performed, which is attached at one end to the leading edge of the media and at the other end to take-up means arranged downstream of the laminator device, such that said carrier travels through the laminator device.

The carrier allows to load the media to the laminator before starting the printing operation. The user doesn't need to wait for the printer to print and output a first length of media, in order to perform the loading in the laminator.

In one embodiment, said carrier comprises a length of film which is suitable to be used for laminating the media in the laminator device.

The use of the lamination film itself as a carrier is simple and cost-effective, avoiding the need of providing additional elements.

In an alternative embodiment, said carrier comprises a sheet of a flexible material and means for attachment thereof to the leading edge of the media. Said sheet of flexible material may be reusable or disposable.

According to a third embodiment, said carrier comprises at least one strip of a flexible material and means for attachment thereof to the leading edge of the media.

According to an advantageous embodiment, the apparatus further comprises feeding means arranged between an outlet of the printer and an inlet of the laminator device, for guiding and feeding the media that leaves the printer towards the laminator; the provision of such feeding means allows correct introduction of the media in the laminator, avoiding manual intervention that may cause media skew or other defects.

The media may be a web of media on which are printed several consecutive plots.

In a second aspect, the invention provides loading means for loading a media in a printing apparatus comprising a printer to print on said media and a laminator device to laminate at least part of said media, said loading means comprising a carrier, on which no printing is performed, which is attached at one end to the leading edge of the media and at the other end to take-up means arranged downstream of the laminator device, such that said carrier travels through the laminator device.

According to a third aspect of the invention, there is provided a method for loading media in a printing apparatus comprising a printer and a laminator device, in which media that advances and is printed in the printer is subsequently fed in an integrated operation to the laminator device and advanced therethrough to laminate at least part of said media, said method for loading media comprising the steps of:

providing a carrier attached to the leading edge of the media and to take-up means arranged downstream of the laminator device, such that said carrier travels through the laminator; and causing the carrier to advance and lead the media through the laminator.

Once the carrier is properly attached as described, the user may program the jobs to be printed and laminated in the apparatus, and leave without waiting for the start of the printing operation and without the need to subsequently load the media into the laminator.

In one embodiment, said carrier comprises a length of lamination film.

In this case, said step of providing a carrier may comprise:

(a) loading lamination film in the laminator;

(b) causing the lamination film to advance through the laminator device;

(c) attaching the lamination film to said take-up means;

(d) causing the leading edge of a media to advance past the printer until it reaches the laminator device; and (e) laminating a length of media with said lamination film.

The lamination of the first length of media attaches firmly the media to the film carrier.

Preferably, in step (c) a predetermined length of lamination film is attached to said take-up means, and the method further comprises the steps of:

(f) cutting the lamination film; and (g) drawing back media towards the printer while releasing part of said length of lamination film from the take-up means.

The draw back of the media towards the printer has the advantage of allowing to print the media essentially from its leading edge, losing only the short laminated length that is used to attach the media to the film that acts as carrier; thus, it avoids media waste. This is particularly useful in the case of wide media, due to its higher cost and to the distance existing between the printer and the laminator device in the case of a large format apparatus.

The draw back of media is made possible by virtue of the length of film that is attached to the take-up means in the first place.

In one embodiment of the method, using a carrier other than the lamination film, said step of providing a carrier comprises attaching one end of a carrier sheet of a flexible material to the leading edge of the media, passing said sheet at least through the laminator device and attaching the other end of said sheet to the take-up means of the apparatus.

The carrier sheet may be attached to the leading edge of the media before the media is loaded to the printer, and the carrier sheet is then passed through the printer and the laminator device; alternatively, the carrier sheet may be attached to the leading edge of the media when it leaves the printer, and the carrier sheet is then passed through the laminator device.

According to a different embodiment, said step of providing a carrier comprises attaching one end of a carrier sheet of a flexible material to the take-up means, passing said sheet through the laminator device in a direction opposite to the direction of advance, and attaching the other end of said sheet to the leading edge of the media.

In this case the carrier sheet may be a re-usable element, and it could be permanently attached to the take-up means.

In another embodiment, said step of providing a carrier comprises attaching one end of at least one carrier strip of a flexible material to the leading edge of the media, passing said strip at least through the laminator device and attaching the other end of said strip to the take-up means of the apparatus.

Alternatively, said step of providing a carrier comprises attaching one end of at least one carrier strip of a flexible material to the take-up means, passing said strip through the laminator device in a direction opposite to the direction of advance, and attaching the other end of said strip to the leading edge of the media.

The number of strips and their spacing will depend upon the media width to be printed in each case.

In the embodiments of the method in which the carrier is not the lamination film, said carrier may be attached to the media by means of an adhesive.

All the embodiments that use a carrier sheet or strips allow to print the media from the leading edge, and thus they avoid media waste.

BRIEF DESCRIPTION OF THE DRAWINGS

Particular embodiments of the present invention will be described in the following, only by way of non-limiting example, with reference to the appended drawings, in which.

DESCRIPTION OF PREFERRED EMBODIMENTS

Figure 1:
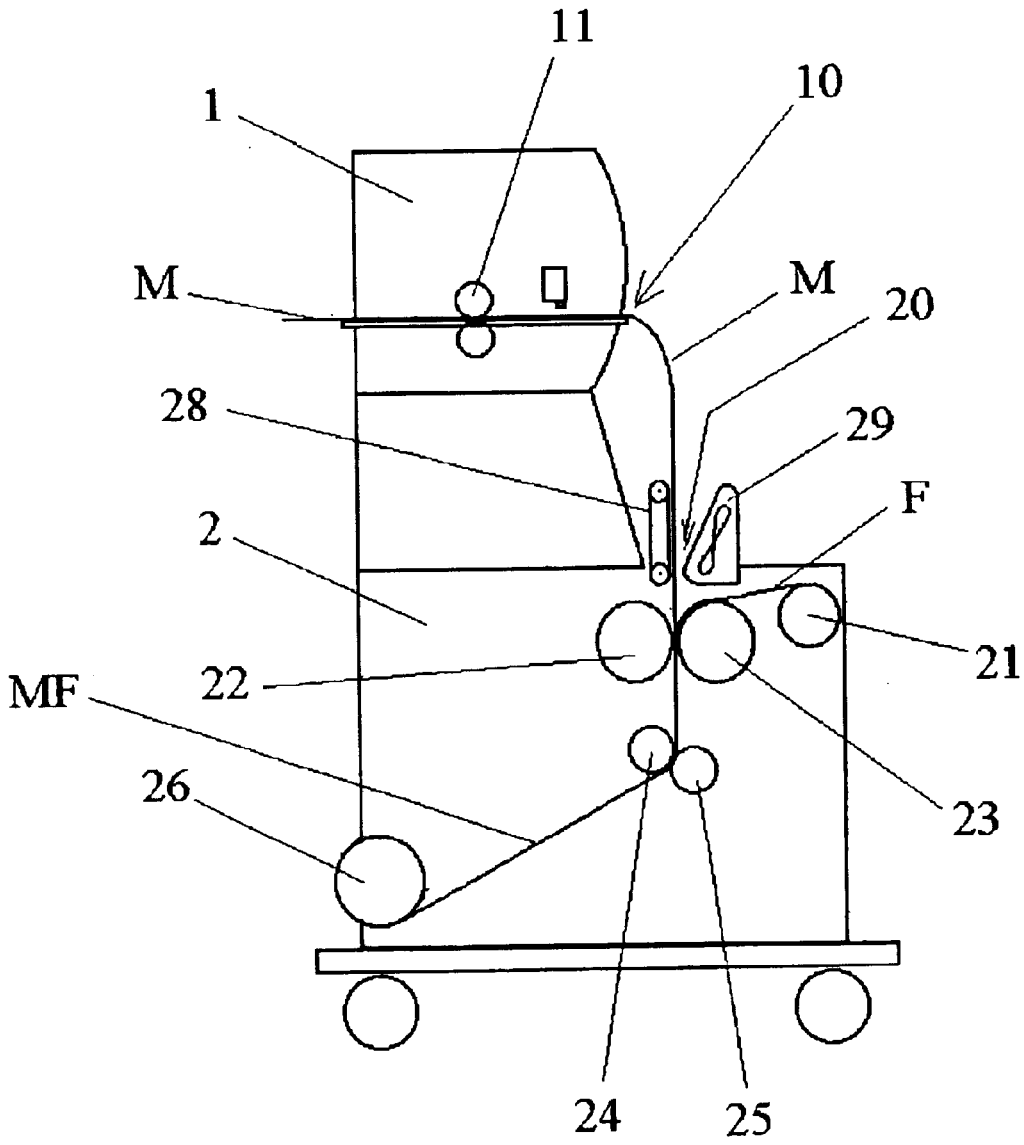
FIG. 1 shows schematically in side elevation a printing apparatus according to an embodiment of the present invention.

FIG. 1 shows an embodiment of the present invention in which a printing device 1, for example an inkjet printer, is provided with a laminator device 2 in one integrated apparatus.

By 'integrated' apparatus it is here meant that the devices 1 and 2 may operate in succession, a media being able to pass from one device to the other, such that the media may be printed and thereafter laminated by the apparatus in a continuous operation, without normally requiring manual intervention.

In the figure, a media M is printed in the printing device 1, which is provided with means 11 for the advance of the media, and leaves through the outlet 10, to be then fed to the laminator 2 through its inlet 20.

The media M will normally consist of a continuous web of paper or similar material, on which several plots are printed one after the other.

After printing each plot, the printer 1 stops for processing data, advances a small amount of media to separate two subsequent plots from each other, and starts printing the next plot.

The laminator 2 holds at least a roll 21 of a suitable film F; such a film F may comprise a layer of plastic material and a layer of thermally activable adhesive. There can also be a second roll of film (not shown), if it is desired to laminate both sides of the media.

The laminator 2 also comprises a pair of idle lamination rolls 22 and 23, which can also be referred to as a 'laminating nip', through which the media M and film F are conducted. Rolls 22 and 23 are suitable for applying pressure and heat to the media and film, in order to perform the laminating operation causing the film to adhere to the printed media.

Downstream of the lamination rolls, the laminated media MF is engaged by a pair of driving rollers 24,25 which make it advance through the laminator; downstream of these driving rollers, it is wound on a take-up reel 26.

Preferably the media M leaving the printer 1 is fed to the laminator 2 by means of a feeding device, because the media tends to curl and skew, such that manual introduction has the danger of a bad positioning of the media at the inlet of the laminator. This is especially serious in the case of large media widths.

A feeding device which may be used for this purpose, and which also performs other function, comprises conveyor belts 28 and fans 29, schematically shown in FIG. 1. The feeding device and its operation will be described in more detail later on, with reference to FIGS. 5 to 11.

A printing method according to the invention, carried out on the described apparatus, may be as follows: media M is first loaded in the printer 1 and then its leading edge is linked with the lamination means 22,23 of the laminator 2 and the take-up means 26 of the apparatus; the media M is then printed in the printer 1 and at least partly laminated in the laminator 2.

The laminator 2 is advantageously placed substantially below the printer 1, in order to allow easy access to the printer 1 and in order to reduce the overall floor space taken up by the apparatus; for this reason, there is a distance between the printer outlet 10 and the laminator inlet 20, and even more distance between the printhead of the printer 1 and the lamination rolls 22,23.

On the other hand, the lamination operation cannot be normally stopped within one plot, in order to avoid defects in the laminating operation, so when starting to process a web of media the laminating operation cannot start until a certain length of media has been printed.

One possibility for initially loading the media web into the laminator would be to print a first plot in the printer without feeding the outputted media to the laminator, and load the leading edge of the media through the laminator once this first plot has been wholly or at least partly printed; however, this would require the intervention of a user some time after the beginning on the printing process, in order to perform or control the loading of the media into the laminator; furthermore, the possibility of damage to the printed media being left loose cannot be ruled out.

Alternatively, the leading edge of the media may be advanced through the lamination rolls 22,23, driving rollers 24,25 and take-up reel 26 before starting any printing process; however, in this case a length of media would be wasted, and since media can be quite expensive, it's desirable to avoid such a waste.

Embodiments of the present invention have been developed in order to overcome at least partly the mentioned drawbacks; these embodiments solve or alleviate the drawbacks by using carrier means which are attached at one end to the leading edge of the media and at the other end to the take-up means 26 of the apparatus, and travel through the laminator 2.

A first embodiment of a printing apparatus and method according to the invention will now be described with reference to FIGS. 2*a* to 2*e*; in this embodiment, the lamination film F is used as said carrier means.

FIGS. 2*a* to 2*e* are schematic partial views of a printing apparatus showing the different steps followed for loading the media M into the laminator at the beginning of a printing operation, when a new web or sheet of media has to be loaded in the apparatus to be printed and at least partly laminated.

In these figures, the thickness of the film and media have been exaggerated for the sake of clarity.

Figure 2A:
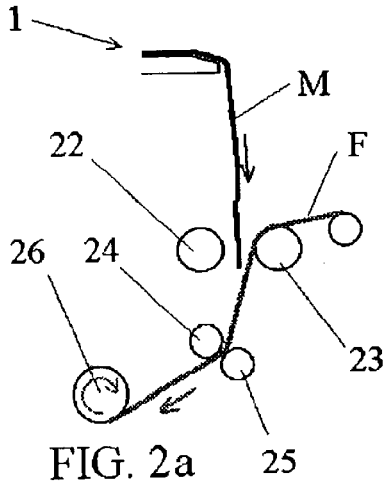
FIGS. 2*a* to 2*e* show the steps that are carried out for loading a web of media to the printer and laminator, according to an embodiment of the invention.

As can be seen in FIG. 2*a*, the lamination film F is first advanced through the open lamination rolls 22,23 and through the driving rollers 24,25, and a length of the film F is wound on the take-up reel 26; unprinted media M is advanced through the printer 1 and through the feeding device 28,29 (not shown in this figure), until its leading edge reaches the lamination rolls 22,23.

Figure 2B:
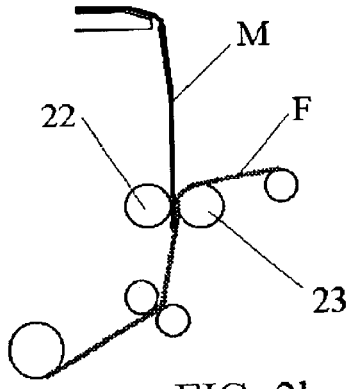
Figure 2C:
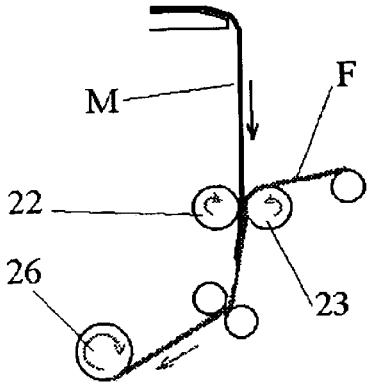
Figure 2D:
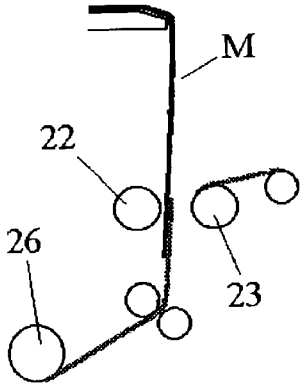

As shown in FIGS. 2*b* and 2*c*, the lamination rolls 22,23 are then closed and a length of media, for example about 20 cm, is laminated together with the lamination film F.

Then (FIG. 2*d*) the lamination rolls 22,23 are opened again and the film is cut, either upstream or downstream of the lamination rolls, depending on the architecture or the laminator. At this stage, as shown in the figure, the media M is firmly attached to a length of film F which travels through all the laminator and is wound on the take-up reel.

Figure 2E:
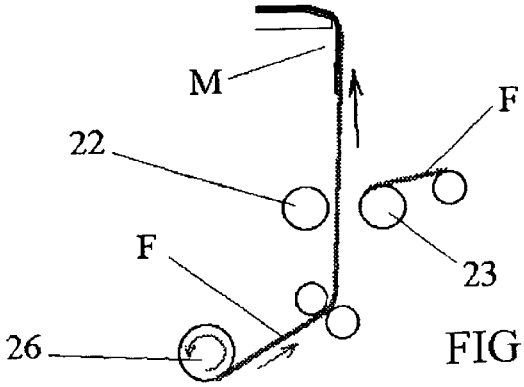

Finally, as shown in FIG. 2*e*, the media is made to travel back towards the printer 1, while the film travels back through the driving rollers 24,25 and the open lamination rolls 22,23; at the end of this operation the film is still attached to the take-up reel 26, by virtue of the length of film F that was wound on the take-up reel 26 in the first step.

The media M is drawn back until the laminated part is arranged near the printhead, and thus the media web or sheet can be printed practically from the beginning, with a minimum media waste.

Counting and/or sensing devices may be provided to control the length of media that has to be outputted by the printer at the beginning of the loading operation, the length to be laminated, the length that has to be drawn back towards the printer, the operation of the feeding device 28,29, and so on.

Once the loading steps have been performed, the apparatus is ready for operation, and the user may program the printing and laminating jobs and start the process.

The waste of film F which is used as carrier means is not very significant, since the cost of film is much lower than the cost of media.

It is thus possible for the user to simply program the printing and laminating jobs, load the film in the laminator and the media in the printer and then leave the apparatus working unattended, without waiting for the first plot to be printed.

Figure 3:
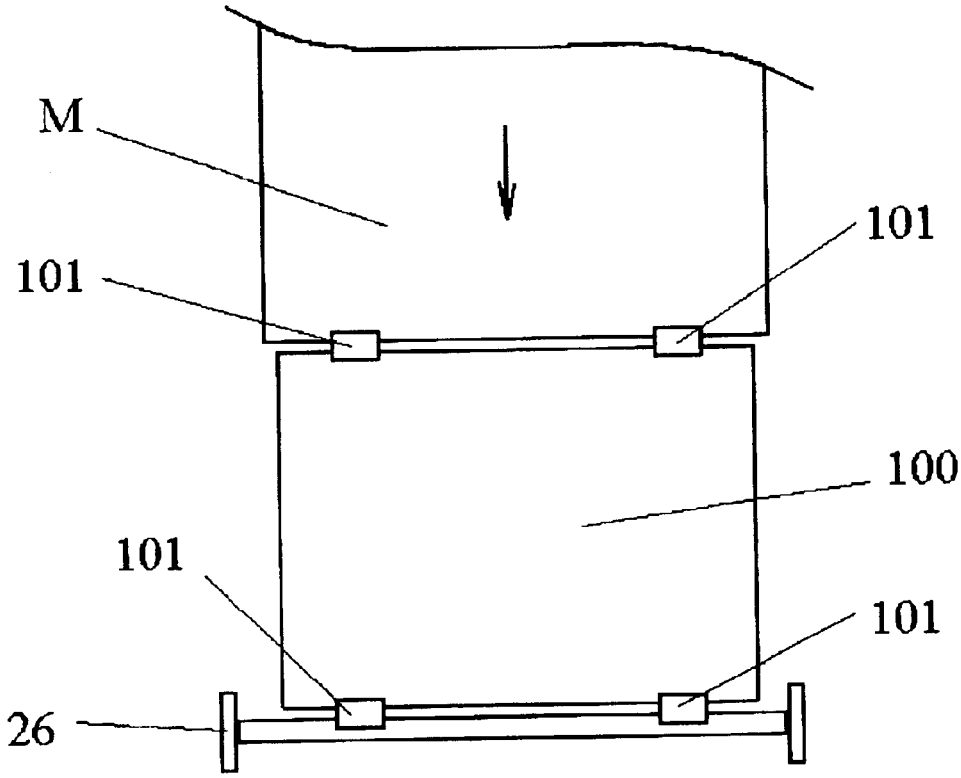
FIG. 3 shows schematically in front elevation a media leaving the printer and attached to carrier means according to one embodiment of the invention.

An alternative embodiment is illustrated in FIG. 3, which shows schematically the leading edge of the media M and a carrier means 100 attached to it and to the take-up reel 26. For the sake of clarity, the parts of the apparatus other than the take-up reel have been omitted; it is understood that the carrier means 100 travels through the lamination rolls 22,23 and the driving rollers 24,25. The arrow indicates the direction of advance of the media from the printer to the laminator.

In this case, the carrier means which links the leading edge of the media M and the take-up reel 26 is constituted by a sheet of flexible material 100.

The carrier sheet 100 can be attached to the leading edge of the media by means of adhesive, clip guides or other fastening means 101, then passed through the lamination rolls 22,23 and driving rollers 24,25, and finally fastened to the take-up reel 26, such that the media is linked to the take-up reel from the beginning of the printing operation, but at the same time there is no waste of printing media.

The carrier sheet 100 may take several forms, as explained in the following.

The carrier sheet 100 can be a disposable sheet of a cheap material, e.g. paper or plastic, to be supplied with the media, with the apparatus or as a separate item; if supplied with the media, it can also be supplied attached to it, e.g. by means of an adhesive.

In all cases, the control means of the apparatus will sense or otherwise determine when the first printed plot reaches the laminator device in order to start the laminating operation, if applicable.

Alternatively, the carrier sheet such as 100 may be reusable (e.g. made of plastic, canvas or the like); in this case it may be attached to the media and then to the take-up reel, as described above, or it may be permanently attached to the take-up reel or its spindle. In this case, in the first place the sheet 100 will be passed backwards through the driving rollers 24,25 and the lamination rolls 22,23 to reach the leading edge of the media M, between the outlet of the printer and the inlet of the laminator, and then it will be attached to the media M.

Figure 4:
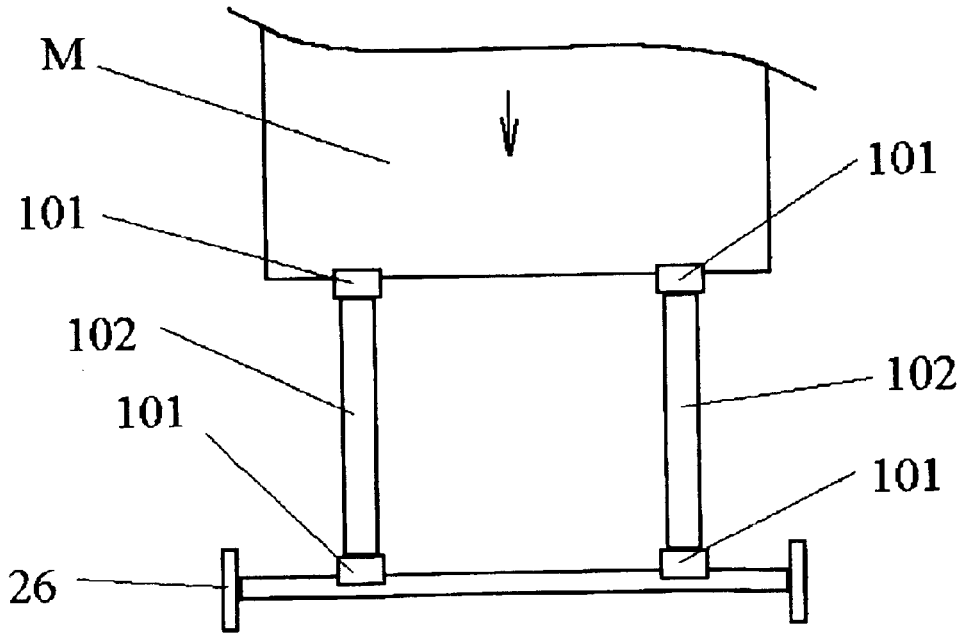
FIG. 4 is a view similar to that of FIG. 3, for an alternative embodiment of the carrier means.

In a further embodiment, the carrier means may be made up of one or more strips 102, either reusable or disposable as described for the carrier sheet 100; one example of two strips 102 attached to the media M and to the take-up reel 26 is shown in FIG. 4.

The attachment of the strips 102 to the media M and to the take-up means may be similar to the previous embodiment; the number of strips may vary according to the width of the media and other requirements.

A printing method according to one embodiment of the invention thus involves loading the media M to be printed through the printer 1 and providing a carrier made of flexible material, for example a sheet or strips, attached at one end to the leading edge of the media M leaving the printer and at the other end to the laminator take-up means 26, said carrier being arranged to run through the laminator; and then starting the printing and laminating operations.

Figure 5:
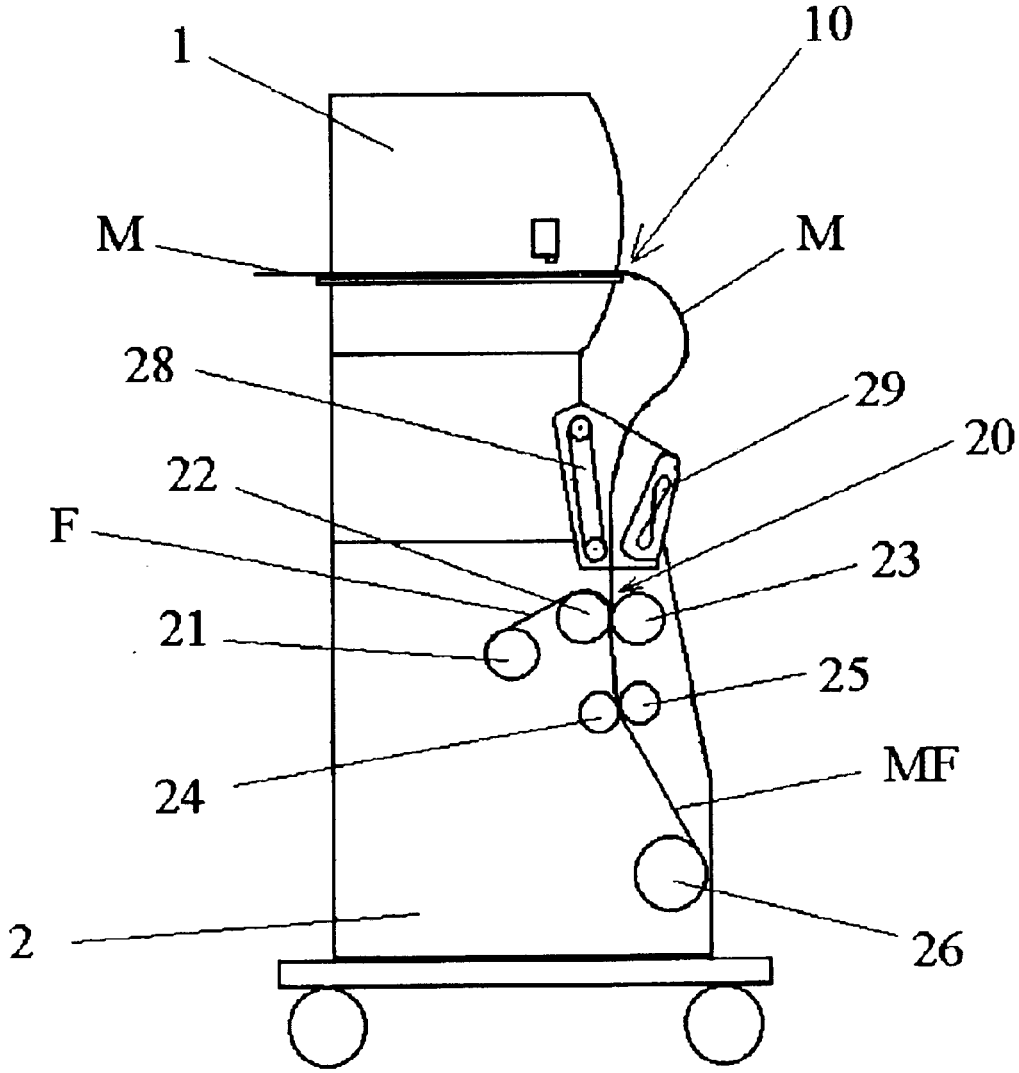
FIGS. 5 and 6 show a printing apparatus according to a slightly different embodiment of the invention.
Figure 6:
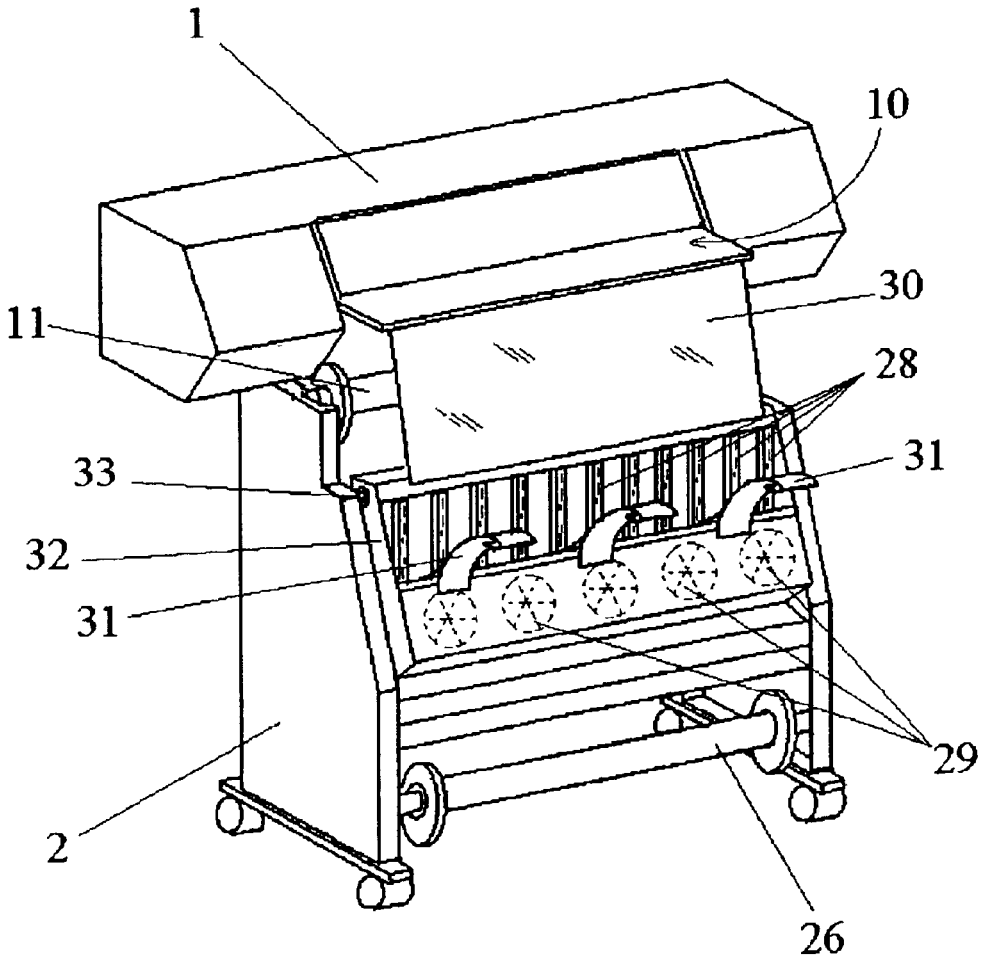

FIGS. 5 and 6 show an apparatus similar to that of FIG. 1, with a slightly different layout of the elements and also including a feeding device 28,29 for feeding the media to the laminator. Elements of this embodiment that are similar to those of the previous figures have the same reference numerals and will not be described again.

FIG. 5 is a schematic view showing the position of the feeding device, which comprises conveyor belts 28 and fans 29 arranged along the media path between the outlet 10 of the printer and the inlet 20 of the laminator.

FIG. 6 shows the apparatus in perspective without any media loaded. The figure shows a blank media reel 11, from which the media is fed to the printer 1, and also the take-up reel 26 described above.

The feeding device includes a plurality of conveyor belts 28 arranged parallel to each other and with their feed path in substantially vertical direction, and a plurality of fans 29 which are arranged side-by-side and facing the conveyor belts 28, the fans and belts being arranged on opposite sides of the media path, upstream of the laminator.

Fans 29 are shown in phantom lines in FIG. 6 because they are not visible in this perspective.

The fans 29 generate an air stream such as to urge the media towards the conveyor belts 28, and the latter are set in motion to guide the leading edge of the media with an adequate orientation.

In the example, the conveyor belts 28 are made of high-friction rubber, and they are about 19 mm wide; they are spaced about 75 mm from each other (between centres), in order to provide enough support and friction surface for the flexible media and at the same time allow air flow between the belts in the region that is not covered by the media when the latter is narrower than the maximum admitted width, thus helping reduce the air flow towards the laminator.

The conveyor belts 28 could be replaced by a different type of transport means able to drive the media by friction, such as an array of wheels with a high-friction surface, e.g. made of rubber.

Similarly, the fans 29 could be replaced by other elements, e.g. a vacuum system arranged behind the conveyor belts to create a depression to attract the media towards the belts by vacuum.

The fans system, vacuum system or other air stream generating system could be located in a different position in the apparatus, and the air stream could be conducted towards the media and the belts by means of tubing.

In order to prevent the edge of the media leaving the printer from missing the space between the fans and belts, the apparatus further comprises deflectors 30 and 31 arranged at either sides of the media path upstream of the fans and belts.

The deflectors allow unattended operation of the apparatus; they are not needed if a user manually guides the leading edge of the media to enter the space between conveyor belts 28 and fans 29.

In the embodiment shown in FIG. 6, deflector 30 is a sheet of flexible material, such as plastic, removably mounted between the outlet 10 of the printer and the upper edge of the belts 28. Deflector 30 prevents the leading edge of the media from deviating towards the apparatus, where it could get caught in the media feed roll or in other parts of the device. The deflector 30 is removable in order to allow access to the inner parts of the apparatus, and it could be replaced by a rigid metal cover or other suitable housing element.

On the other side of the media path, a plurality of outer deflectors 31 prevent the media edge from falling outwards and missing the space between fans 29 and belts 28.

Deflectors 31 are sloped and curved and project outwards, as shown in FIG. 6, so as to conduct the media edge towards the space between the belts and fans: for this purpose, the base of the deflectors 31 is positioned on the housing of the fans, at about 50 mm from the belts 28, while the upper side of the deflectors 31 is spaced about 140 mm from the belts and the deflector 30.

Deflectors 31 are made of a plastic material including about 2% of an antistatic component, and are coated with a sheet of polypropylene about 0.5 mm thick for preventing the deflector from damaging the printed plot when they come into contact.

The conveyor belts 28 and fans 29 are arranged in a housing 32 (FIG. 6) which can be pivoted with respect to the apparatus by virtue of a hinge axis 33; this allows access to the inner part of the laminator 2 for maintenance and cleaning operations and in order to load the lamination film, if needed.

The deflectors 31 are mounted on the housing 32, and the lower edge of deflector 30 also may be removably fixed to it.

The operation of the apparatus with the fans and conveyors system will now be described.

Figure 7:
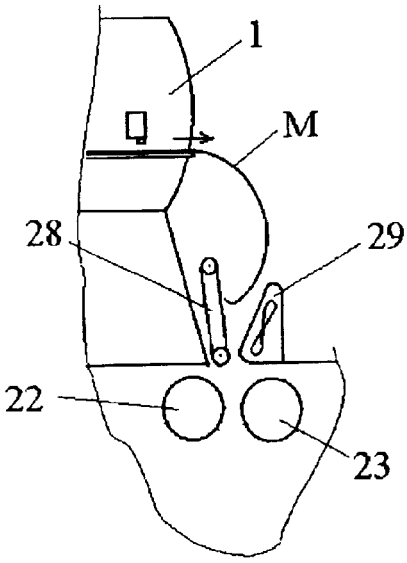
FIGS. 7 to 11 show different steps of operations performed by the feeding means of the apparatus of FIGS. 5 and 6.

FIGS. 7 to 11 show different steps of the feeding operation that is performed when the leading edge of the media leaves the printer and has to be fed to the laminator, as described above during the loading operation. In FIG. 7, a leading edge of the media M leaving the printer advances towards the laminator with a degree of curling, which will vary from case to case depending e.g. on the type of media and the density of ink in the plot.

Figure 8:
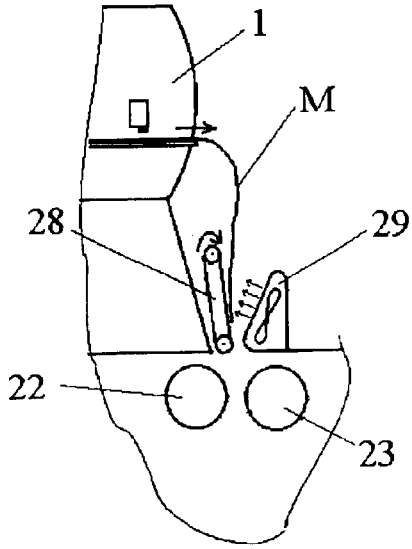

When the media edge reaches the space between the fans 29 and conveyor belts 28, the fans are powered and the belts start to advance in the direction shown by the arrows in FIG. 8, at a speed of about 100 mm/sec, thus faster than the media advance speed, such that the belts tend to pull the media edge downwards and undo the curling, and to straighten the media and exert a degree of downward pulling action thereon; this ensures a more uniform positioning of the media edge along all its width and thus avoids skew of the media when its leading edge enters the laminator.

The fans urge the media towards the belts in order to ensure enough friction between them.

Figure 9:
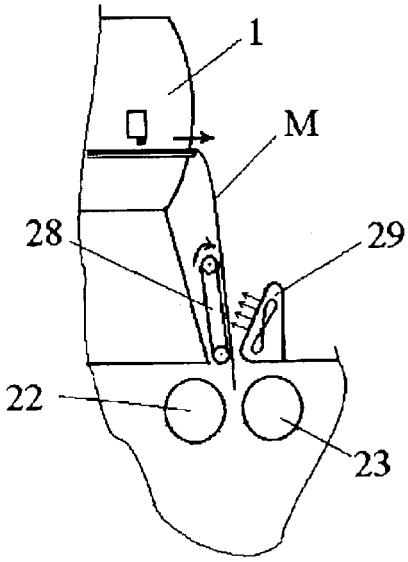
Figure 10:
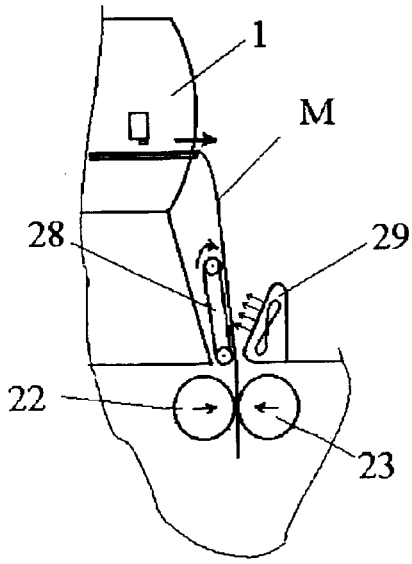

FIG. 9 shows the situation in which the leading edge of the media approaches the lamination rolls 22,23. There are then two possible ways of operation, as described hereinafter.

According to one embodiment, after the leading edge of the media travels through the laminator rolls 22,23 the rolls are closed (FIG. 10) gripping the media M and the film F, the latter not being shown in FIGS. 7 to 11 for the sake of clarity.

According to an alternative embodiment, it is also possible to close the lamination rolls before the media edge reaches them, and start laminating film without media; the conveyor belts feed the media until its leading edge enters between the lamination rolls which are already rotating.

In both cases, once the edge of the media is caught between the laminator rolls, a small length of media is laminated with film and then the laminator rolls may be opened to draw back media towards the printer, as described above.

The whole loading operation described can be automated, or the user can be requested to feed the leading edge of the media to the space between the conveyor belts 28 and fans 29 in FIG. 1.

Apart from working for feeding the leading edge of the media to the laminator during the loading operation as described, the fans 29 and belts 28 perform other functions, as will be described in the following.

Figure 11:
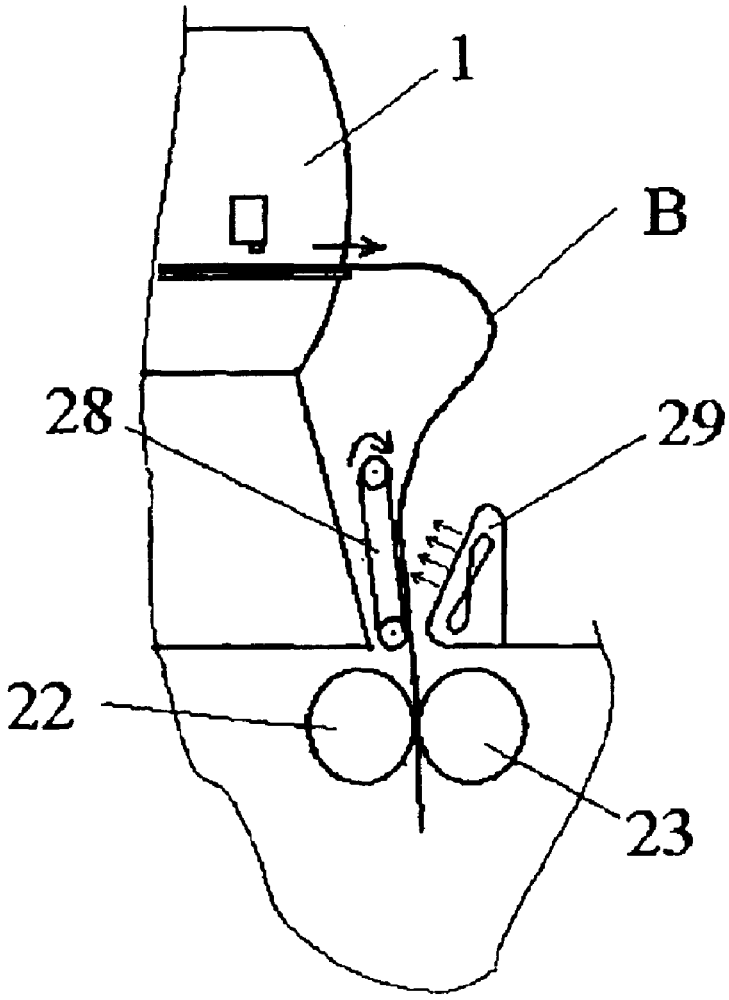

Once the media is loaded in the laminator and the printing operation starts, as shown in FIG. 11, the conveyor belts 28 and fans 29 work to form the media buffer B in a position upstream of the feeding system 28,29: for this purpose the conveyor belts 28 and the driving rollers 24,25 of the laminator are slowed down, such that the advance of the media in the laminator is smaller than the advance of the media in the printer, and a length of media buffer is formed.

The air stream generated by the fans 29 and the friction of the media with the belts 28 force the buffer to remain upstream of the feeding system: this allows to control the shape of the buffer and also prevents the printed side of the media from contacting the surfaces of the housing of the apparatus, throughout all the printing and laminating process.

During normal operation of the apparatus, when the printer and the laminator are working on the same plot or web of media, the fans and belts also maintain the correct angle of entrance of the media to the laminator; the fans and belts may also be used to slightly slow down the media in this region (this is done by driving the belts with a speed lower than that of advance of the media in the laminator, or stopping them completely), thereby generating a slight back tension in the media before it enters the laminator: this helps the media enter the laminator free from wrinkles.

Finally, the fans may also contribute to some extent to the drying of the printed plot before it is laminated.

The operation of the fans 29 and belts 28 is controlled by the control means of the apparatus (not shown) to be adequately syncronised with the advance of the media in the laminator, the closure of the laminator rolls 22,23 and driving rollers 24,25, and so on.

The conveyor belts 28 may be powered by means of a transmission from the driving rollers 24,25 of the laminator, or they can have an independent drive. The latter case has the advantage of easily allowing higher speeds for the belts in certain steps of operation, which is useful for avoiding skew, as explained above.

The apparatus may include sensor means to control when the leading edge of the media reaches the region of the belts and fans, or alternatively this may be estimated by counting the length of media that has left the printer.

Although the take-up means for the laminated media have been embodied in the above description by a take-up reel, it should be noted that other devices can be used for collecting the laminated media downstream of the laminator, and that any suitable device for this purpose should be considered encompassed by the definition of "take-up means" as used herein.

What is claimed is:

1. A printing apparatus comprising a printer and a laminator device, in which media that advances and is printed in the printer is subsequently fed in an integrated operation to the laminator device and advanced therethrough to laminate at least part of said media, the apparatus further comprising means for loading in the laminator device the leading edge of the media leaving the printer, wherein said loading means comprise a carrier, on which no printing is performed, which is attached at one end to the leading edge of the media and at the other end to take-up means arranged downstream of the laminator device, such that said carrier travels through the laminator device, the attachment of the carrier to the leading edge of the media being performed before printing on said media.

2. A printing apparatus as claimed in claim 1, wherein said carrier comprises a length of film which is suitable to be used for laminating the media in the laminator device.

3. A printing apparatus as claimed in claim 1, wherein said carrier comprises a sheet of a flexible material and means for attachment thereof to the leading edge of the media.

4. A printing apparatus as claimed in claim 3, wherein said sheet of flexible material is reusable.

5. A printing apparatus as claimed in claim 3, wherein said sheet of flexible material is disposable.

6. A printing apparatus as claimed in claim 1, wherein said carrier comprises at least one strip of a flexible material and means for attachment thereof to the leading edge of the media.

7. A printing apparatus as claimed in claim 1, further comprising feeding means arranged between an outlet of the printer and an inlet of the laminator device, for guiding and feeding the media that leaves the printer towards the laminator.

8. A printing apparatus as claimed in claim 1, wherein the media is a web of media on which are printed several consecutive plots.

9. A printing apparatus comprising a printer for printing on media, a laminator device for laminating media and a media take-up device arranged downstream of the laminator device, in which media that advances and is printed in the printer is subsequently fed in an integrated operation to the laminator device and advanced therethrough to laminate at least part of said media, the apparatus further comprising a carrier, on which no printing is performed, for loading in the laminator device a leading edge of the media leaving the printer, said carrier being attached at one end to the leading edge of the media and at the other end to said media take-up means, such that said carrier travels through the laminator device, the attachment of the carrier to the leading edge of the media being performed before printing on said media.

10. Loading means for loading a media in a printing apparatus comprising a printer to print on said media and a laminator device to laminate at least part of said media, said loading means comprising a carrier, on which no printing is performed, which is attached at one end to the leading edge of the media and at the other end to take-up means arranged downstream of the laminator device, such that said carrier travels through the laminator device, the attachment of the carrier to the leading edge of the media being performed before printing on said media.

11. A method for loading media in a printing apparatus comprising a printer and a laminator device, in which media that advances and is printed in the printer is subsequently fed in an integrated operation to the laminator device and advanced therethrough to laminate at least part of said media, said method for loading media comprising the steps of:

providing a carrier attached to the leading edge of the media and to take-up means arranged downstream of the laminator device, such that said carrier travels through the laminator, the attachment of the carrier to the leading edge of the media being performed before printing on said media; and causing the carrier to advance and lead the media through the laminator.

12. A method as claimed in claim 11, wherein said carrier comprises a length of lamination film.

13. A method as claimed in claim 12, wherein said step of providing a carrier comprises:

(a) loading lamination film in the laminator;

(b) causing the lamination film to advance through the laminator device;

(c) attaching the lamination film to said take-up means;

(d) causing the leading edge of a media to advance past the printer until it reaches the laminator device; and (e) laminating a length of media with said lamination film.

14. A method as claimed in claim 13, wherein in step (c) a predetermined length of lamination film is attached to said take-up means, and which further comprises the steps of:

(f) cutting the lamination film; and (g) drawing back media towards the printer while releasing part of said length of lamination film from the take-up means.

15. A method as claimed in claim 11, wherein said step of providing a carrier comprises attaching one end of a carrier sheet of a flexible material to the take-up means, passing said sheet through the laminator device in a direction opposite to the direction of advance, and attaching the other end of said sheet to the leading edge of the media.

16. A method as claimed in claim 11, wherein said step of providing a carrier comprises attaching one end of at least one carrier strip of a flexible material to the leading edge of the media, passing said strip at least through the laminator device and attaching the other end of said strip to the take-up means of the apparatus.

17. A method as claimed in claim 11, wherein said step of providing a carrier comprises attaching one end of at least one carrier strip of a flexible material to the take-up means, passing said strip through the laminator device in a direction opposite to the direction of advance, and attaching the other end of said strip to the leading edge of the media.

18. A method as claimed in claim 11, wherein said step of providing a carrier comprises attaching one end of a carrier sheet of a flexible material to the leading edge of the media, passing said sheet at least through the laminator device and attaching the other end of said sheet to the take-up means of the apparatus.

19. A method as claimed in claim 18, wherein the carrier sheet is attached to the leading edge of the media before the media is loaded to the printer, and the carrier sheet is then passed through the printer and the laminator device.

20. A method as claimed in claim 18, wherein the carrier sheet is attached to the leading edge of the media when it leaves the printer, and the carrier sheet is then passed through the laminator device.

21. A method as claimed in claim 18, wherein the carrier is attached to the media by means of an adhesive.

* * * * *